US005357677A

United States Patent [19]

West

[11] Patent Number: 5,357,677

[45] Date of Patent: Oct. 25, 1994

[54] TOE NAIL CLIPPER APPARATUS

[75] Inventor: Juston W. West, Lameas, Tex.

[73] Assignee: The Juston West Co., Rockwell, Tex.

[21] Appl. No.: 127,168

[22] Filed: Sep. 27, 1993

[51] Int. Cl.[5] ..... A45D 29/02

[52] U.S. Cl. ..... 30/28; 30/177; 30/183; 30/321; 132/73.5

[58] Field of Search ..... 30/26, 27, 28, 145, 30/175, 176, 177, 183, 184, 241, 242, 231, 321; 132/73.5, 75.4, 75.5

[56] References Cited

U.S. PATENT DOCUMENTS 3,855,699 12/1974 Charlett ..... 30/242
4,847,994 7/1989 Dunn, Jr. ..... 30/28
4,893,406 1/1990 Larson ..... 30/28

FOREIGN PATENT DOCUMENTS 0959833 2/1957 Fed. Rep. of Germany ..... 30/28
0853901 11/1960 United Kingdom ..... 30/241

*Primary Examiner*—Eugenia Jones
*Assistant Examiner*—Allan M. Schrock
*Attorney, Agent, or Firm*—John E. Vandigriff

[57] ABSTRACT

A toe nail clipper apparatus has a nail clipper connected on one end of an elongated member and a pistol-type grip mounted on the other end. A cord attached to the nail clipper and a trigger adjacent to the handle actuates the clipper. The elongated member may have a pivotal joint near the clipper end of the elongated member to permit moving the clipper in an arc.

17 Claims, 4 Drawing Sheets

TOE NAIL CLIPPER APPARATUS

FIELD OF THE INVENTION

This invention relates to nail clipper apparatus, and more particularly to a clipper apparatus for clipping toe nails with a single hand and without having to bend so that the toes may be touched with the hands.

BACKGROUND OF THE INVENTION

Conventional nail clippers are well known, and for the most part are operated by individuals for clipping both the finger nails and toenails. In some instances, because of age or physical problems, it is not possible for the individual to bend sufficiently to reach the toes with the conventional clipping apparatus.

U.S. Pat. No. 4,893,406 illustrates an extension apparatus for clipping toenails. This apparatus utilizes a cable apparatus for pushing downward on the clippers to provide clipping action. It is not apparent that the apparatus can be operated with a single hand. It appears that one hand is used to hold the apparatus, and the other hand is used to press downward on the cable to close the clipper during clipping.

U.S. Pat. No. 4,847,994, is to an apparatus that uses a pair of scissor handles to actuate a plunger rod to close the clipper cutting jaws. Because the scissor handles do not provide a firm grip on the apparatus, it would appear that both hands are required to operate the apparatus.

None of the prior art defines an apparatus that can be securely held and operated with a single hand. This is an important feature when the elderly or disabled may not have the use of both hands to operate the apparatus.

SUMMARY OF THE INVENTION

The invention is to a hand held clipper with an elongated structure for clipping the toe nails. A pistol type grip ensures a firm means for holding the clipper with one hand, and a trigger connected to a pull cord causes the clipper jaws to close, clipping the toenail. The elongated member includes several rollers around which the pull cord partially wraps to provide smooth pulling action.

An adjustable device is connected between two pieces of the cord to provide an adjustment to allow for stretching of the pull cord, and to provide means for pre-tensioning the nail clipper actuation lever.

The elongated member may also include two hinged members to allow the nail clipper to be rotated in an arc to allow proper clipping of different toe nails.

Other features include, in combination with the clipper apparatus, nail file means, and magnifying means.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
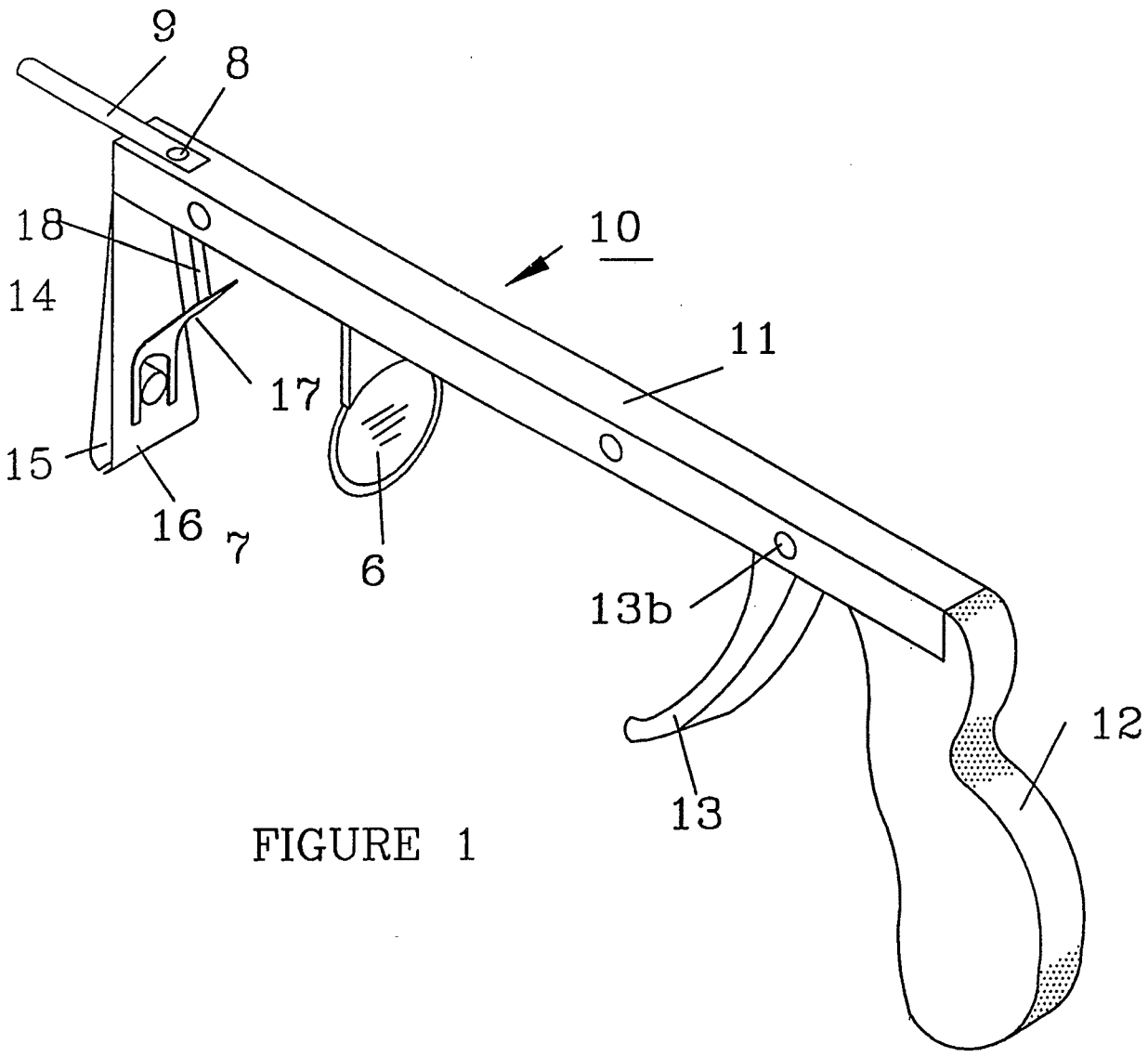
FIG. 1 illustrates a nail clipper apparatus of the present invention.

FIG. 1 illustrates a remotely actuated toe nail clipper according to the present invention. Clipper apparatus 10 includes an elongated body 11 attached to a pistol type handle 12. On elongated body 11, opposite handle 12 is a nail clipper 14. Clipper 14 has a pair of generally parallel spaced spring steel cutting jaws 15 and 16 which are loosely connected by pin 7. When lever 17 is pulled toward the clipper, cutting jaws are forced together, cutting a nail placed between the jaws.

Cord 18, connected to lever 17 and trigger 13, pulls lever toward cutter 14 when trigger 13 is pulled, closing the cutting jaws 15 and 16. Trigger 13 is pivotally secured to elongated member 11 by pin **13*b***.

Mounted on the end of elongated member 11 is a nail file 9 that is pivotally connected by pin 8. When not in use, nail file 9 is pivoted around and stored over elongated member 11. A magnifying glass 6 may be mounted on elongated member 11 to provide a magnified image of the toe and clipper.

Figure 2:
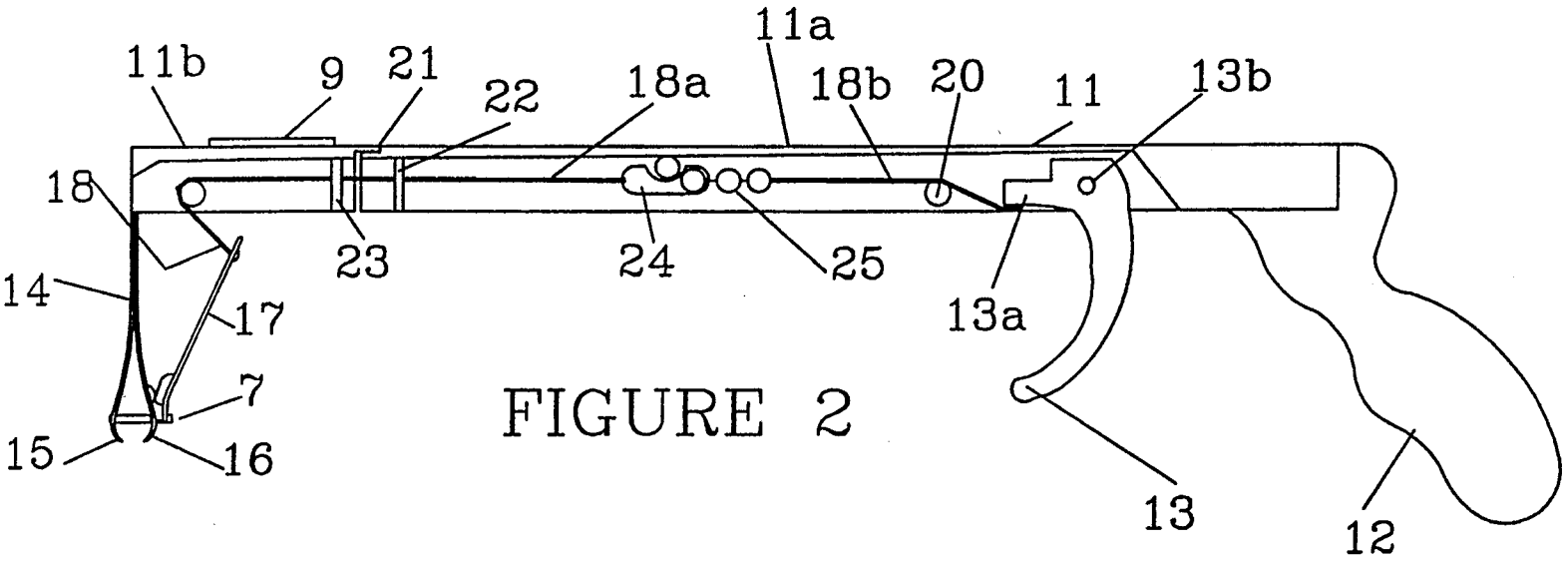
FIG. 2 is a side view of the clipper apparatus with a section removed to show the pull cord apparatus.

FIG. 2 is a side view of the toe nail clipper of the present invention with a section of elongated member 11 removed to show the cord actuating components. Cord 18 is connected to actuation lever 17, extends around pulley/roller 19 and is attached to ball-chain link 24. Ball-chain 25 is held in link 24 and is attached to cord **18*a* that extends over roller 20 and is attached to end 13*a* of trigger 13. Cord 18*a* extends under trigger end 13*a* and extends up through a hole (not illustrated) in 13*a***.

Ball-chain 25 and link 24 are used to adjust the length of the pull cord 18 to compensate for stretching of cord 18, and to permit pre-tensioning of toe nail lever 17, as will be explained below. Ball-chain 25 and link 24 may be replaced, for example, by a turn-buckle for adjusting the length of cord 18.

Cord 18 extends through guides 22 and 23, described below with reference to FIGS. 4 and 5, which are used in conjunction with the pivot 21 attaching two parts **11*a* and 11*b* of elongated member 11**.

As illustrated in FIG. 2, clipper 14 is in an open position with cutting jaws 15 and 16 open, and actuation lever is in an open position, spaced away from clipper 14.

Figure 3:
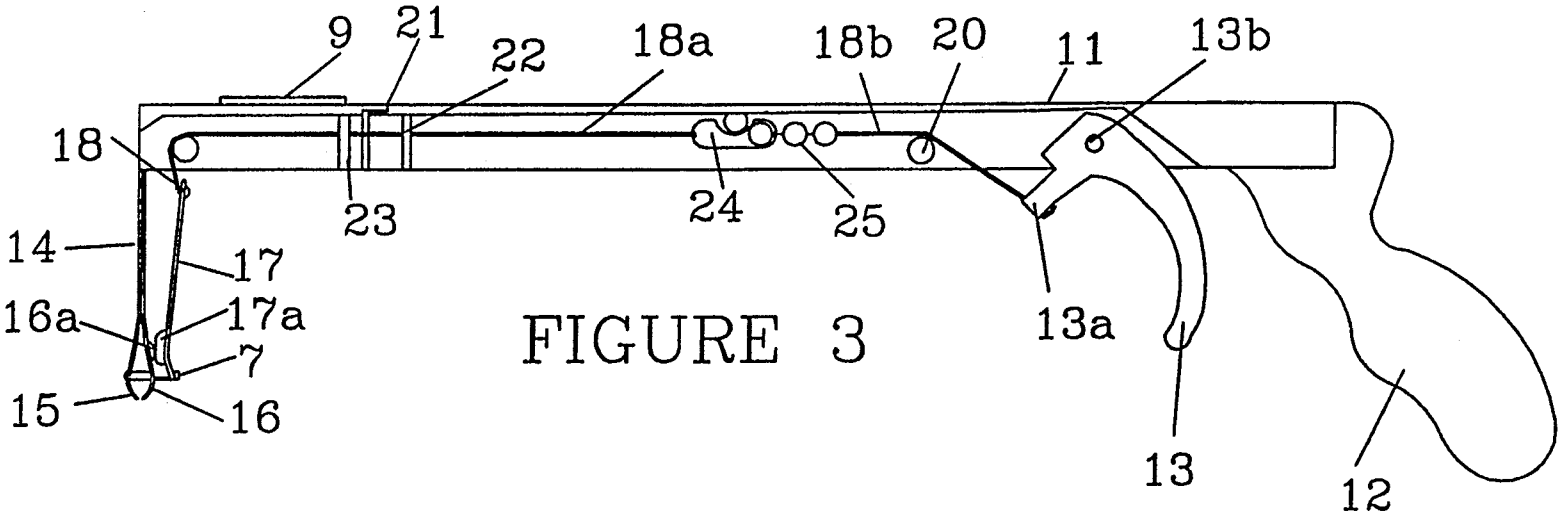
FIG. 3 is a side view as in FIG. 2 with the trigger pulled to close the nail clipper jaws.

FIG. 3 illustrates nail cutter in a closed or cutting position. Nail cutter 14 is placed over a toe with a toe nail in between cutting jaws 15 and 16. When trigger 13 is pulled, trigger end **13*a* pulls on cord 18, pulling lever 17 towards cutter body 14. On lever 17 is a cam surface 17*a* that mates with cam surface 16*a* on jaw 16. When lever 17 is moved by cord 18, the two cam surfaces meet, moving jaw 16 along pin 7, engaging jaw 16 with jaw 15**, cutting a toe nail between the two jaws.

Pre-tensioning of cutter 14 is possible by adjusting the length of cord 18 by adjusting ball-chain 24 and link 24 such that lever 17 is pulled partially towards cutter 14 engaging cams **16*a* and 17*a*. Since the pressure required to closed jaws 15 and 16 by lever 17 and cams 16*a* and 17*a* is greater when cams 16*a* and 17*a* first engage, the amount of pressure required to close jaws 15 and 16 can be reduced by pre-tensioning lever 17 with cams 16*a* and 17*a* engaged. This can be an important consideration when operating the clipper since elderly or disabled persons may have minimal strength, and may have problems squeezing trigger 13 if the amount of pressure were not reduced by pre-tensioning lever 17**.

Pre-tensioning may also be caused by attaching a spring (not illustrated) to cord 18 and a fixed place on elongated body 11 to pull the cord toward trigger 13.

An important feature of the invention is the type of handle. The pistol type grip and trigger actuation allows for the operator to securely grip the apparatus with only one hand. Prior art apparatus usually require two hands to operate toe nail clippers, or provide actuation means that does not provide secure gripping of the clipper with one hand while operating the clipper.

Figure 4:
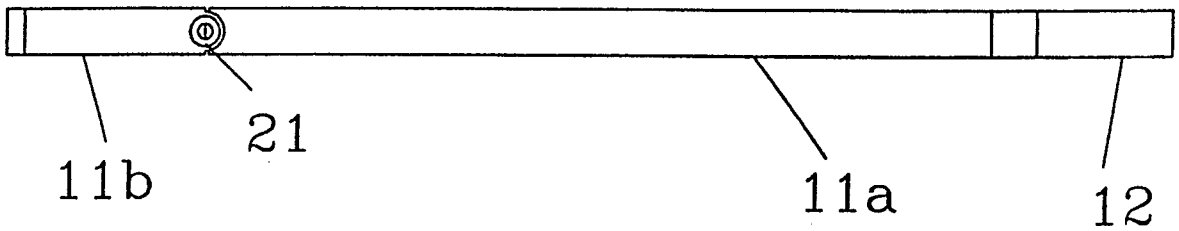
FIG. 4 is a top view of the clipper apparatus.

FIG. 4 is a top view of the toe nail clipper having elongated member 11 and handle 12. Elongated member 11 has two parts, parts 11*a* and 11*b*. Part 11*a* is secured to handle 12, and part 11*b* is pivotally attached to part 11*a*, by pivot hinge 21. The two parts 11*a*, and 11*b* are attached together such that part 11*b* may be pivoted in an arc. This compensates for clipping the ends or sides of toe nails so that the entire toe nail clipping apparatus does not have to be turned in an awkward direction or manner to clip portions of the toe nail. A friction or spring washer (not illustrated) is placed between the interface of parts 11*a* and 11*b* so that end 11*b* is firmly held in the position after it is positioned. Positioning is by holding part 11*a* and pivoting 11*b* by hand.

Figure 5:
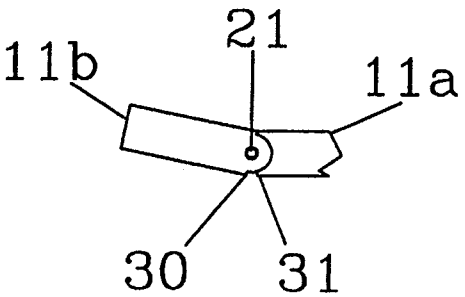
FIG. 5 is a partial top view showing the hinged parts rotated.

FIG. 5 shows a part of elongated member 11*a* with end 11*b* pivoted. As mentioned above, two guides 22 and 23 are placed in the ends of parts 11*a* and 11*b*, respectively. These guides hold cord 18 centered in the ends of parts of 11*a* and 11*b* adjacent to pivot 21 to prevent contact of cord 18 with the edges of the parts 11*a* and 11*b*. Contact during pivoting may cause abrasion of cord 18.

The amount of pivoting of part 11*b* is limited by the shoulders 30 and 31. The amount of pivoting can be predetermined by the amount of space between shoulders 30 and 31.

What is claimed:

1. A toe nail clipping apparatus comprising:

an elongated body formed of two parts pivotally connected to each other by a pivot hinge a pistol grip handle on a first end of said elongated body;

a nail clipping device on a second end of said elongated body, having two spring members, joined together at first ends of said spring members and connected to said elongated body at said joined first ends, and having two cutting jaws biased apart on second ends of said spring members, and a lever for moving the two jaws together for cutting a nail;

an actuating trigger connected to said elongated body by a pivotal connection adjacent said pistol grip handle; and a cord connected between said trigger and said lever for moving said lever in a direction away from said trigger and toward said two spring members, moving the two cutter jaws together when said trigger is rotated around said pivotal connection toward said pistol grip handle.

2. The toe nail clipping apparatus according to claim 1, including an adjustment device connected to said cord, for adjusting the length of said cord.

3. The toe nail clipping apparatus according to claim 2, wherein said adjustment device is a ball-chain and link device.

4. The toe nail clipping apparatus according to claim 1, including a nail file mounted on said second end of said elongated body.

5. The toe nail clipping apparatus according to claim 1, including a magnifying glass mounted between said trigger and said clipping device for presenting an enlarged image to a user of the toe nail clipper apparatus.

6. The toe nail clipping apparatus according to claim 1, wherein said cord extends over two rollers between said trigger and said lever on said clipping device.

7. The toe nail clipping apparatus according to claim 1, including two guides for supporting said cord on each side of said pivot hinge.

8. A toe nail clipping apparatus comprising:

an elongated body formed of two parts pivotally connected to each other by a pivot hinge;

a pistol grip handle on a first end of said elongated body;

a nail clipping device, having two spring members, joined together at first ends of said spring members and connected to said elongated body at a second end, and having two cutting jaws biased apart on second ends of said spring members, and a lever for moving the two jaws together for cutting a nail;

an actuating trigger connected to said elongated body by a pivotal connection adjacent said pistol grip handle; and a cord connected between said trigger and said lever for moving said lever toward said two spring members, moving the two cutter jaws together when said trigger is rotated around the pivotal connection toward said pistol grip handle.

9. The toe nail clipping apparatus according to claim 8, including an adjustment device connected to said cord, for adjusting the length of said cord.

10. The toe nail clipping apparatus according to claim 9, wherein said adjustment device is a ball-chain and link device.

11. The toe nail clipping apparatus according to claim 8, including a nail file mounted on said second end of said elongated body.

12. The toe nail clipping apparatus according to claim 8, including a magnifying glass mounted between said trigger and said clipping device for presenting an enlarged image to a user of the toe nail clipping apparatus.

13. The toe nail clipping apparatus according to claim 8, wherein said cord extends over two rollers between said trigger and said lever on said clipping device.

14. The toe nail clipping apparatus according to claim 8, including two guides for supporting said cord on each side of said pivot hinge.

15. A toe nail clipping apparatus comprising:

an elongated body formed of two parts pivotally connected to each other by a pivot hinge;

a pistol grip handle on a first end of said elongated body;

a nail clipping device on a second end of said elongated body, having two spring members, joined together at first ends of said spring members and connected to said elongated body, and having two cutting jaws biased apart on second ends of said spring members, and a lever for moving the two jaws together for cutting a nail;

an actuating trigger connected to said elongated body by a pivotal connection adjacent said pistol grip handle; and a cord extending over a pair of rollers and connected between said trigger and said lever, for moving said lever toward said two spring members, moving the two cutter jaws on said spring levers together when said trigger is rotated around the pivotal connection toward said pistol grip handle.

16. The toe nail clipping apparatus according to claim 15, including a pair of shoulders on said elongated body to limit the amount of pivot between the two parts.

17. The toe nail clipping apparatus according to claim 16, including a pre-tensioning device for pre-tensioning the two spring members.

* * * * *